US007900745B1

(12) United States Patent
Tindal

(10) Patent No.: US 7,900,745 B1
(45) Date of Patent: Mar. 8, 2011

(54) MOTOR DRIVEN LIFTING ASSEMBLY

(76) Inventor: Kenneth W. Tindal, Conway, SC (US)

( * ) Notice: Subject to any disclaimer, the term of this patent is extended or adjusted under 35 U.S.C. 154(b) by 935 days.

(21) Appl. No.: 11/728,600

(22) Filed: Mar. 27, 2007

(51) Int. Cl.
*E06C 7/16* (2006.01)

(52) U.S. Cl. ..... 182/103

(58) Field of Classification Search ..... 182/103
See application file for complete search history.

(56) References Cited

U.S. PATENT DOCUMENTS

| | | | | |
|---|---|---|---|---|
| 2,338,833 | A * | 1/1944 | Pinnock | 182/103 |
| 2,394,148 | A | 2/1946 | Campbell | |
| 2,714,434 | A | 8/1955 | Peterson | |
| 3,115,211 | A * | 12/1963 | Ostrander, Jr. | 182/103 |
| 3,476,212 | A | 11/1969 | Eakins | |
| 3,666,054 | A | 5/1972 | Ellings et al. | |
| 3,891,062 | A * | 6/1975 | Geneste | 187/245 |
| 4,183,423 | A | 1/1980 | Lewis | |
| 4,450,935 | A | 5/1984 | Gustavus | |
| 4,546,853 | A | 10/1985 | Hanson | |
| 5,064,020 | A * | 11/1991 | Eagleson | 182/20 |
| 6,311,800 | B1 | 11/2001 | St-Germain et al. | |
| 6,533,070 | B1 * | 3/2003 | Elrod | 182/103 |
| 7,004,288 | B2 | 2/2006 | Araki et al. | |
| 7,350,621 | B2 * | 4/2008 | Abraham | 182/129 |
| 7,424,932 | B1 * | 9/2008 | Murphy | 182/103 |

* cited by examiner

*Primary Examiner* — Alvin C Chin-Shue

(57) ABSTRACT

A motor driven lifting assembly includes a ladder, a plurality of fastening members removably and pivotally attached to an upper end of the ladder, and a plurality of wheels attached to a lower end of the ladder. A platform supports the air-conditioning unit and is located at an anterior face of the ladder. A mechanism raises and lowers the platform such that the platform is linearly adjustable along an entire longitudinal length of the ladder. The raising and lowering mechanism is anchored in close proximity to the lower portion of the ladder such that the raising and lowering mechanism is easily operable by the user.

10 Claims, 9 Drawing Sheets

MOTOR DRIVEN LIFTING ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to platforms for ladders and, more particularly, to a motor driven lifting assembly for assisting a user to raise and lower an air-conditioning unit above a ground surface and along a ladder.

2. Prior Art

It is well known that ladders have been commonly used in order to carry a person or worker up or down along a building wall or other structure. Extreme difficulty is often encountered in lifting heavy objects to the top of a house, to a second or higher story of a building, or onto a roof. This can be accomplished with a crane, but the expense of using a crane is often prohibitive. For example, it would be too expensive to rent a crane in order to install a typical air conditioning unit on the roof of a private residence. In addition, it would be difficult and expensive to transport a large piece of equipment such as a crane to a job site.

One prior art example shows a lift apparatus for use with a ladder having two spaced upright stringers and a plurality of horizontal rungs bridging the stringers and spaced at a distance vertically from one another. The lift apparatus comprises a frame, a prime mover mounted on the frame and having a rotatable output shaft, and at least one pair of sprocket systems spaced apart vertically from each other. At least one of the sprocket systems is operatively coupled with the output shaft of the prime mover. An endless driving force transmitting mechanism can pass around the pair of the sprocket systems. A controller is provided for controlling the prime mover in such a manner as to selectively rotate the output shaft thereof in forward or reverse direction, or stop it. An operating mechanism is provided for causing a plurality of gripper elements to be engaged with the corresponding rungs of the ladder. The gripper elements are carried by the endless driving force transmitting mechanism and spaced at a distance substantially corresponding to that of the rungs of the ladder. A platform is secured to the frame for supporting an operator thereon. Unfortunately, this prior art example is designed to raise and lower an individual and is not designed for use in raising and lowering heavy inanimate objects.

Another prior art example shows a raising system for scaffolding, elevator cabins and the like which comprises a vertical stationary beam member from one side of which equally vertically spaced similar rack teeth are protruding, each tooth having a substantially horizontal straight top face, a framework guided for up and down movement along said beam member, a power driven shaft rotatably supported by said framework and carrying spaced radial supports, a series of parallel idle shafts extending between the supports, equally spaced from one another and radially equally spaced from the driven shaft, and a plurality of cylindrical roller assemblies rotatably mounted on the idle shafts and adapted to come in successive rolling engagement with the top faces of said teeth during upward or downward movement of said framework. Each roller assembly includes several rollers disposed side by side. Unfortunately, this prior art example is not designed for use in raising and lowering a heavy inanimate object in cooperation with a ladder.

Accordingly, a need remains for a system in order to overcome the above-noted shortcomings. The present invention satisfies such a need by providing an assembly that is convenient and easy to use, is lightweight yet durable in design, and assists a user to raise and lower an air-conditioning unit above a ground surface. The assembly allows a user to securely place a ladder upon a ground surface and safely raise an air-conditioning unit to a desired height easily and efficiently. Such an assembly allows an individual user to do the work of two or more people. The assembly greatly reduces the possibility of injury to an individual, or damage to an object, and allows a user to accomplish a task more quickly. The present invention is simple to use, inexpensive, and designed for many years of repeated use.

BRIEF SUMMARY OF THE INVENTION

In view of the foregoing background, it is therefore an object of the present invention to provide an assembly for a motor driven lifting assembly. These and other objects, features, and advantages of the invention are provided by a motor driven lifting assembly for assisting a user to raise and lower an air-conditioning unit above a ground surface.

The assembly includes a ladder, a plurality of fastening members removably and pivotally attached to an upper end of the ladder, and a plurality of wheels advantageously attached to a lower end of the ladder. Such fastening members adjustably attach the upper end of the ladder to a support surface during operating conditions such that a more stable environment is effectively created while raising and lowering the platform (herein described below).

The assembly further includes a platform for supporting the air-conditioning unit, and the platform is conveniently located at an anterior face of the ladder. Such a platform includes a planar support member that has top and bottom surfaces. Such a support member is pivotally adjustable such that an air-conditioning unit placed upon the top surface is effectively maintained along a substantially horizontal plane above a ground surface while traveling along the longitudinal length of the ladder. The support member further has top and bottom ends oriented perpendicular to the longitudinal length of the ladder, and pivots about the top end.

The platform further includes first, second, third, and fourth planar panels. Such first and second panels have top ends attached to the top end of the support member, and further have bottom surfaces advantageously spaced from the anterior face of the ladder when the platform is attached to the ladder. Such third and fourth panels have top surfaces advantageously spaced from a posterior face of the ladder when the platform is attached to the ladder and spaced from the bottom surfaces of the first and second panels. The first, second, third, and fourth panels are substantially similar in shape and size and have outside edges effectively extending beyond a lateral width of the ladder.

The platform further includes a plurality of rectilinear spacers having axially opposed top and bottom ends. Such top ends of the spacers are statically attached to the outside edges of the first and second panels respectively, while such bottom ends of the spacers are statically attached to the outside edges of the third and fourth panels respectively. The spacers effectively maintain the first, second, third, and fourth panels rigidly affixed and equidistantly offset from the ladder during operating conditions.

The platform further includes a plurality of wheels directly attached to the spacers respectively, and further advantageously attached to the bottom surface of the first and second panels and the top surface of the third and fourth panels respectively. Such wheels are conveniently located at opposed outside corners of the first, second, third, and fourth panels, and directly contact the anterior and posterior faces of the ladder respectively when the platform is attached thereto.

The platform includes a plurality of telescopically adjustable shafts that have opposed ends pivotally attached to the bottom surface of the support member and the top surfaces of the first and second panels respectively. Such shafts are conveniently located at the opposed outside corners of the bottom ends of the support member and the first and second panels respectively. The shafts have a plurality of apertures formed along a length thereof such that the apertures effectively form a continuous passageway through a diameter of the shafts. A plurality of cotter pins is removably interfitted within the apertures.

The assembly further includes a mechanism for raising and lowering the platform such that the platform is linearly adjustable along an entire longitudinal length of the ladder. Such a raising and lowering mechanism is advantageously anchored in close proximity to the lower end of the ladder such that the raising and lowering mechanism is easily operable by the user. The platform raising and lowering mechanism includes a housing that has a user interface conveniently formed within a top surface thereof, and a motor enclosed within the housing.

The platform raising and lowering mechanism further includes a driveshaft that has a first end directly connected to the motor and a second end extending outwardly from the housing and disposed exterior thereof. Such a driveshaft has a longitudinal axis oriented parallel with the bottom end of the support member, and further has a spool monolithically formed with the second end of the driveshaft. A remote device effectively operates the motor from a distance, and a power cord is included.

The platform raising and lowering mechanism further includes a rectilinear rod effectively spanning along an entire interior width of the ladder. Such a rod is advantageously oriented perpendicular to a longitudinal length of the ladder and further is conveniently anchored in close proximity to the upper end of the ladder. A grooved wheel is attached to a center portion of the rod and is freely rotatable thereabout.

The platform raising and lowering mechanism further includes a flexible cord nested within the grooved wheel. Such a cord has a first end adjustably attached directly to the spool and further has a second end statically attached to the platform. The cord travels along a first linear path defined along the anterior face of the ladder and further travels along a second linear path defined along a posterior face of the ladder. Such first and second linear paths are advantageously registered parallel to each other.

The wheels of the assembly have a diameter greater than a distance between the anterior and posterior faces of the ladder such that the lower end of the ladder effectively remains elevated above the ground surface after the upper end of the ladder is adapted towards the ground surface.

A method for raising and lowering an air-conditioning unit above a ground surface includes the steps of providing a ladder, removably and pivotally attaching a plurality of fastening members to an upper end of the ladder, attaching a plurality of wheels to a lower end of the ladder, supporting the air-conditioning unit on a platform located at an anterior face of the ladder; and raising and lowering the platform such that the platform is linearly adjustable along an entire longitudinal length of the ladder. The raising and lowering mechanism is anchored in close proximity to the lower portion of the ladder such that the raising and lowering mechanism is easily operable by the user.

The method further includes the steps of providing a housing that has a user interface formed within a top surface thereof, providing a motor enclosed within the housing, providing a driveshaft that has a first end directly connected to the motor and a second end extending outwardly from the housing and disposed exterior thereof, providing a remote device for operating the motor from a distance, and providing a power cord. The driveshaft has a longitudinal axis oriented parallel with the bottom edge of the support member, and further has a spool monolithically formed with the second end of the driveshaft.

The method further includes the steps of spanning a rectilinear rod along an entire interior width of the ladder, attaching a grooved wheel to a center portion of the rod and freely rotatable thereabout, and nesting a flexible cord within the grooved wheel. The rod is oriented perpendicular to a longitudinal length of the ladder and further is anchored in close proximity to the upper end of the ladder. The cord has a first end adjustably attached directly to the spool and further has a second end statically attached to the platform. The cord travels along a first linear path defined along the anterior face of the ladder and further travels along a second linear path defined along a posterior face of the ladder. The first and second linear paths are registered parallel to each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
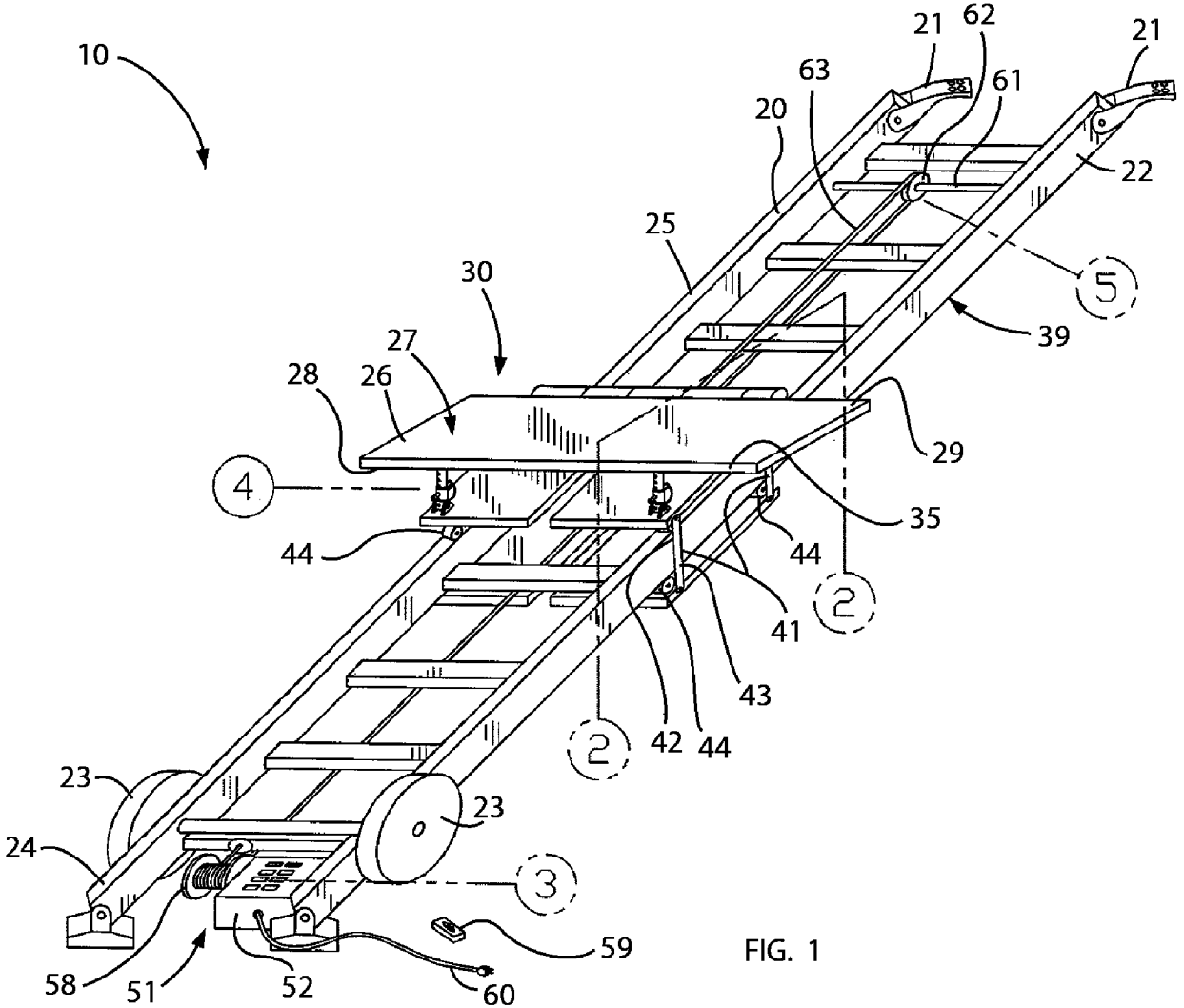
FIG. 1 is a perspective view of the motor driven lifting assembly, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-9 by the reference numeral 10 and is intended to provide a motor driven lifting assembly. It should be understood that the assembly 10 may be used to raise and lower many different types of objects and should not be limited in use to raising and lowering only those types of objects described herein.

Referring to FIGS. 1, 3, 5, 6, and 8, the assembly 10 includes a ladder 20, a plurality of fastening members 21 removably and pivotally attached to an upper end 22 of the ladder 20, and a plurality of wheels 23 attached to a lower end 24 of the ladder 20. The ladder 20 is of a type commercially available to the public and well known within the industry. Such fastening members 21 adjustably attach the upper end 22 of the ladder 20 to a support surface 11 during operating conditions, which is essential such that a more stable environment is created while raising and lowering the platform 30 (herein described below). For example, by attaching the fastening members 21 to a support surface 11 while an air-conditioning unit 12 is being raised and lowered, a user reduces the possibility of the upper end 22 of the ladder 20 prematurely and undesirably disengaging from the support surface 11 and thereby causing injury to an individual, or damage to the air-conditioning unit 12 or support surface 11.

Referring to FIGS. 1, 2, 6 and 8, the assembly 10 further includes a platform 30, for supporting the air-conditioning unit 12, located at an anterior face 25 of the ladder 20. Such a platform 30 includes a planar support member 26 that has top 27 and bottom 28 surfaces. The platform 30 is suitably sized and shaped to accommodate a wide range of commercially produced air-conditioning units 12 readily available to the public. Such a support member 26 is pivotally adjustable, which is critical such that an air-conditioning unit 12 placed upon the top surface 27 of the support member 26 is maintained along a substantially horizontal plane above a ground surface while traveling along the longitudinal length of the ladder 20. Such adjustability allows a user to maintain the air-conditioning unit 12 at a stable horizontal position during operating conditions regardless of the angle of incline of the ladder 20. The support member 26 has top 29 and bottom 35 ends oriented perpendicular to the longitudinal length of the ladder 20, and pivots about the top end 29.

Figure 2:
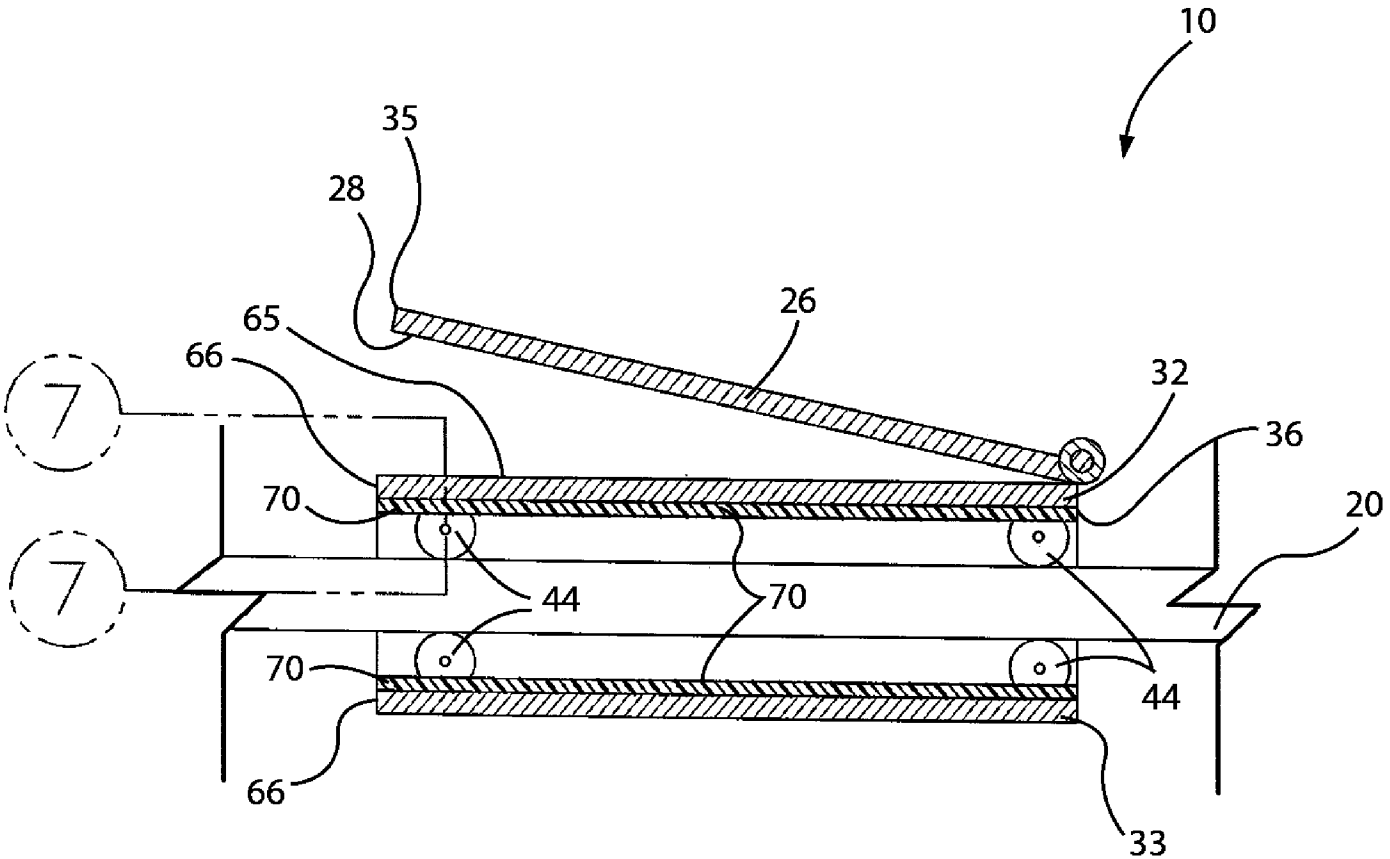
FIG. 2 is a cross sectional view of the platform shown in FIG. 1, taken along 2-2.
Figure 3:
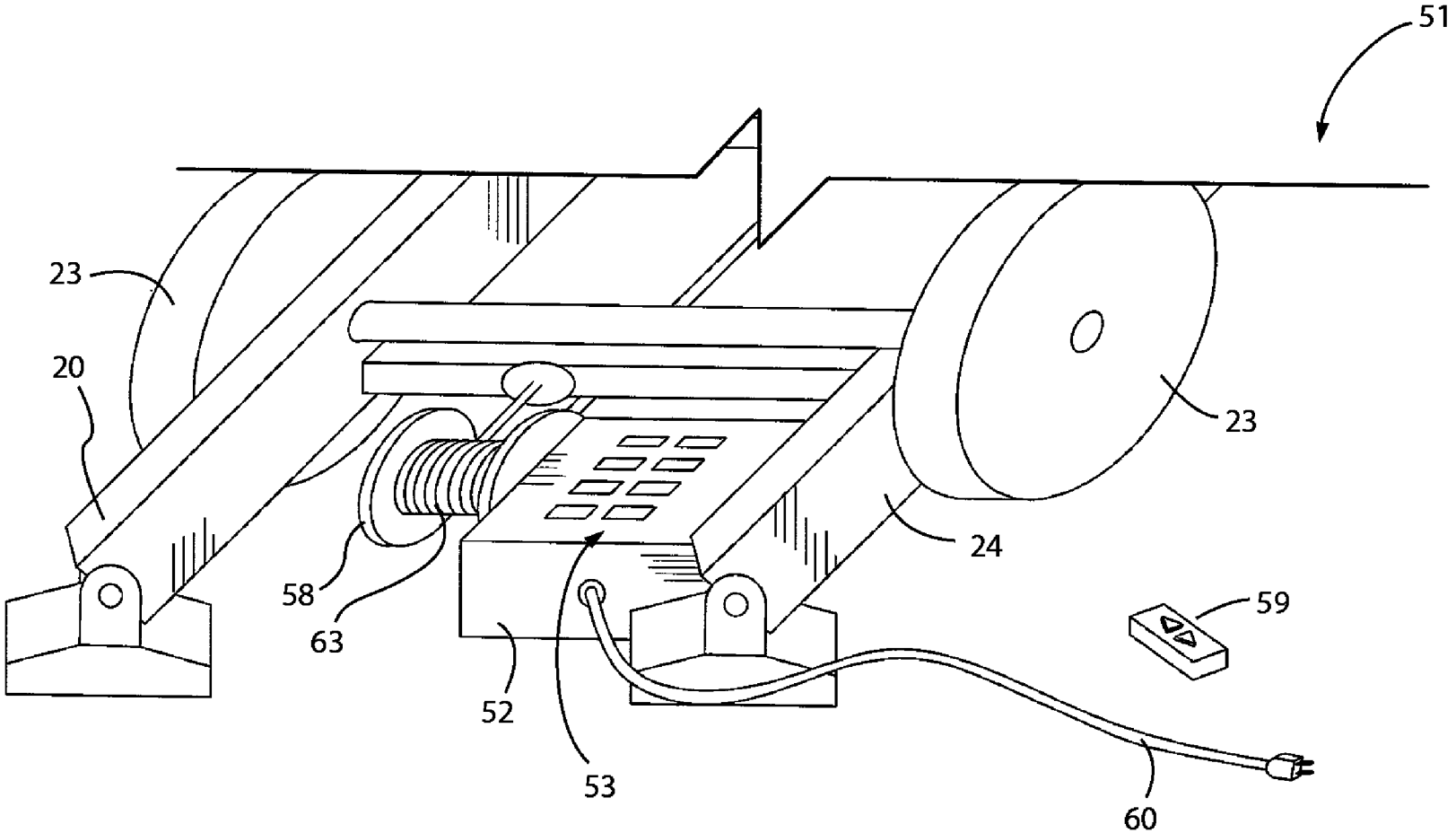
FIG. 3 is a perspective view of the raising and lowering mechanism and the wheels respectively.
Figure 6:
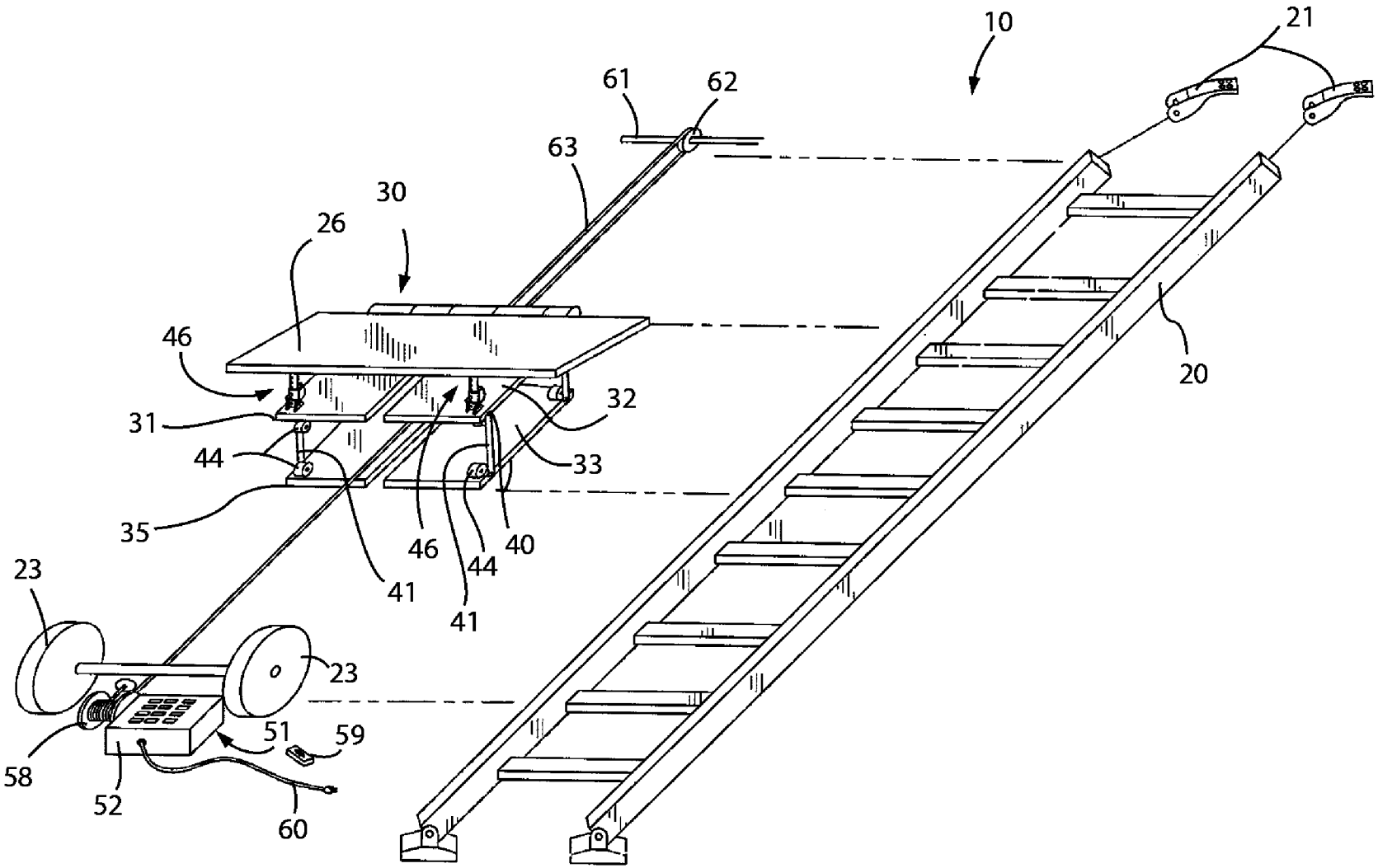
FIG. 6 is an exploded perspective view of the assembly showing the raising and lowering mechanism, the wheels, the platform, the ladder, and the fastening mechanism respectively.

Referring to FIGS. 2 and 6, the platform 30 further includes first 31, second 32, third 33, and fourth 34 planar panels. Such first and second panels 31, 32 have top ends 36 attached to the top end 29 of the support member 26, and further have top surfaces 65 facing the bottom surface 28 of the support member 26 and bottom surfaces 37 spaced from the anterior face 25 of the ladder 20 when the platform 30 is attached to the ladder 20. Such third and fourth panels 33, 34 have top surfaces 38 spaced from a posterior face 39 of the ladder 20 when the platform 30 is attached to the ladder 20 and spaced from the bottom surfaces 37 of the first and second panels 31, 32. The first, second, third, and fourth panels 31, 32, 33, 34 are substantially similar in shape and size and have outside edges 40 extending beyond a lateral width of the ladder 20, and have bottom ends 66 oriented parallel to the bottom end 35 of the support member 26.

Figure 8:
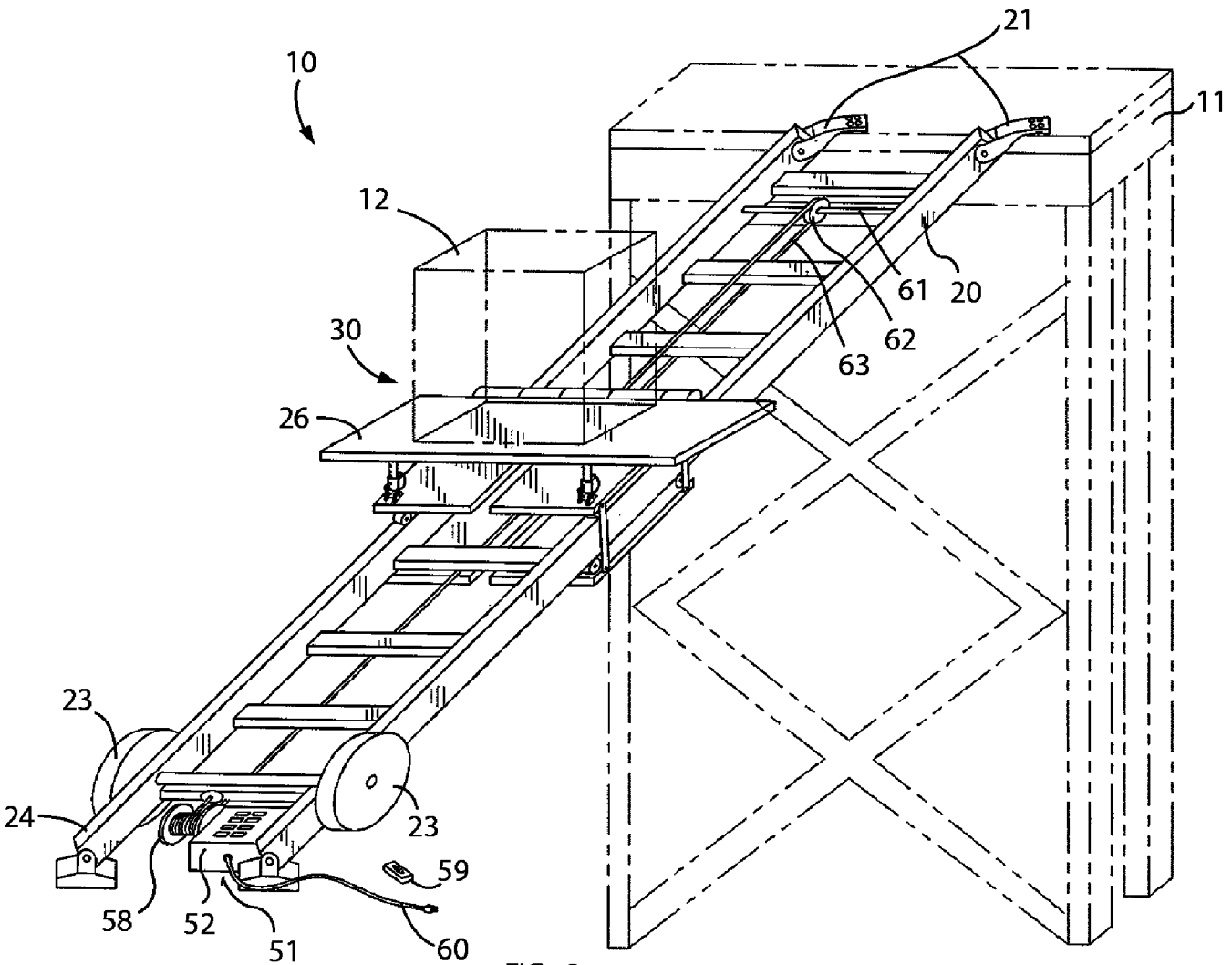
FIG. 8 is a perspective view of the assembly shown attached to a support surface and with an air-conditioning unit placed upon the platform.
Figure 9:
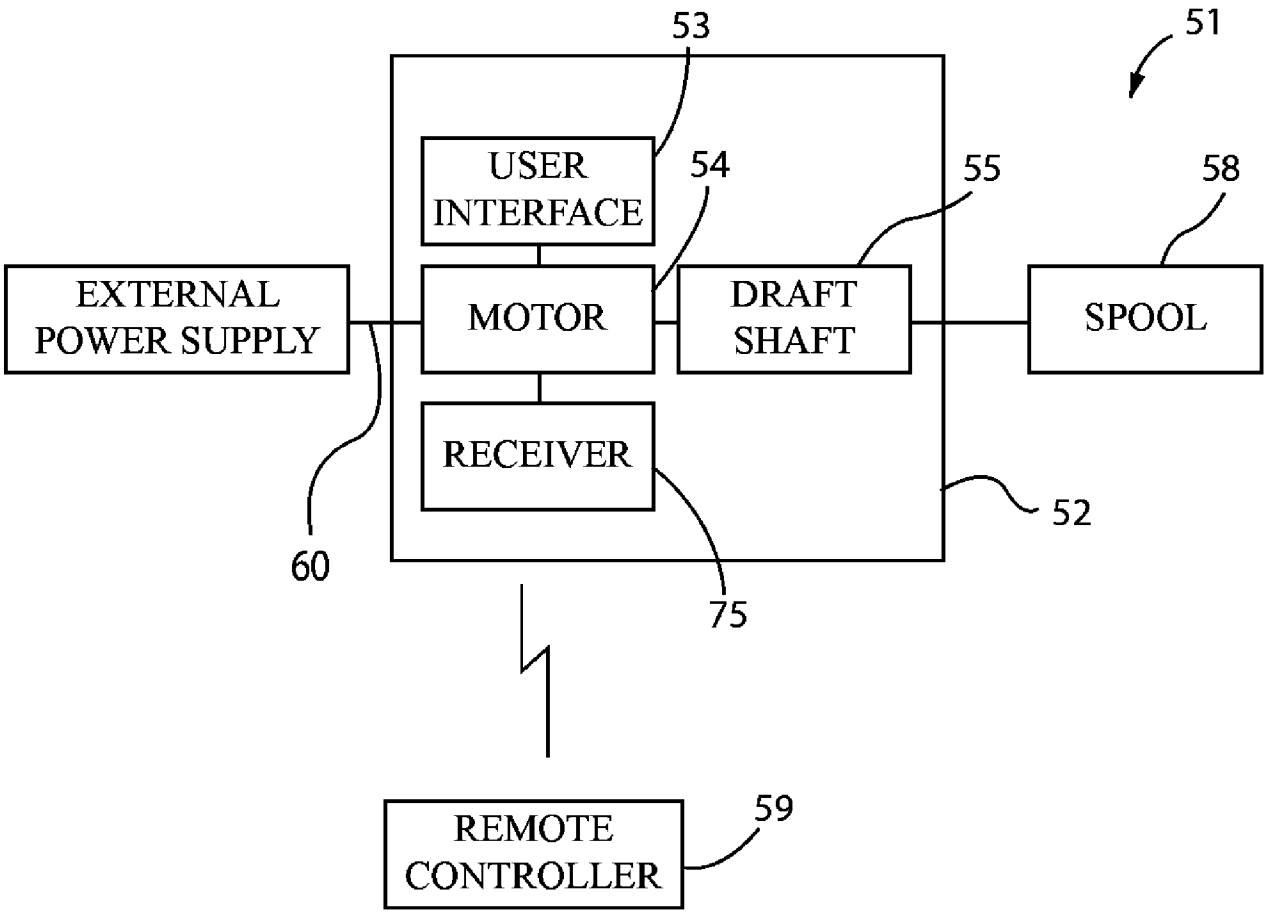
FIG. 9 is a schematic block diagram of the raising and lowering mechanism.

Referring to FIGS. 1 and 8, the platform 30 further includes a plurality of rectilinear spacers 41 having axially opposed top 42 and bottom 43 ends. Such top ends 42 of the spacers 41 are statically attached to the outside edges 40 of the first and second panels 31, 32 respectively, while such bottom ends 43 of the spacers 41 are statically attached to the outside edges 40 of the third and fourth panels 33, 34 respectively. Placement of the spacers 41 on the outside edges 40 of the first, second, third, and fourth panels 31, 32, 33, 34 respectively prevents the spacers 41 from impeding the linear motion of the platform 30 along the longitudinal length of the ladder 20 during raising and lowering of the air-conditioning unit 12. The spacers 41 maintain the first, second, third, and fourth panels 31, 32, 33, 34 rigidly affixed and equidistantly offset from the ladder 20 during operating conditions. Further, the spacers 41 maintain the first, second, third, and fourth panels 31, 32, 33, 34 in a rigid spatial relationship, which is crucial for providing a sufficiently strong construction that allows safe and secure placement of an air-conditioning unit 12 on the support member 26.

Figure 7:
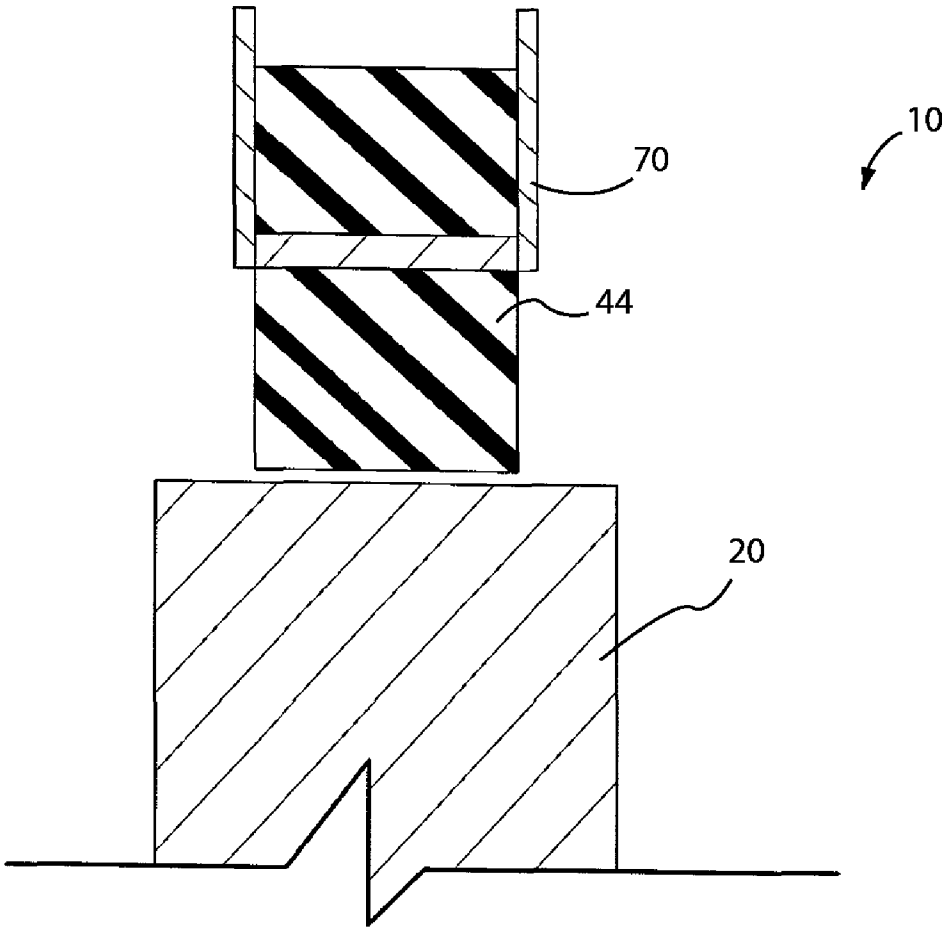
FIG. 7 is a cross sectional view of a track and a wheel, taken along line 7-7.

Referring to FIGS. 1, 2 and 7 the platform 30 further includes a plurality of wheels 44 directly attached to the spacers 41 respectively, without the use of intervening elements, and further attached to the bottom surface 37 of the first and second panels 31, 32 and the top surface 38 of the third and fourth panels 33, 34 respectively. Such wheels 44 are located at opposed outside corners 45 of the first, second, third, and fourth panels 31, 32, 33, 34, and directly contact the anterior and posterior faces 25, 39 of the ladder 20 respectively, without the use of intervening elements, when the platform 30 is attached thereto. The wheels 44 allow the platform 30 to be raised and lowered with a minimum of effort, as well as a minimum of friction, thereby prolonging the usable life of the wheels 44 and reducing the damage that would occur to the first, second, third, and fourth panels 31, 32, 33, 34 and the anterior and posterior faces 25, 39 of the ladder 20 respectively if the wheels 44 were not present.

Again referring to FIGS. 2 and 7, the platform 30 further includes a plurality of linear tracks 70 directly attached to the bottom surface 37 of the first and second panels 31, 32 respectively, and the top surface 38 of the third and fourth panels 33, 34 respectively. Such tracks 70 are oriented parallel to the longitudinal length of the ladder 20 and adjacent to the outside edges 40 of the first, second, third, and fourth panels 31, 32, 33, 34 respectively. The wheels 44 interfit within the tracks 70 and freely rotate therein while the platform 30 is being raised and lowered. The tracks 70 provide a guide for the wheels 44 during operating conditions, which is crucial for maintaining the wheels 44 in a travel path oriented along the longitudinal length of the ladder 20.

Figure 4:
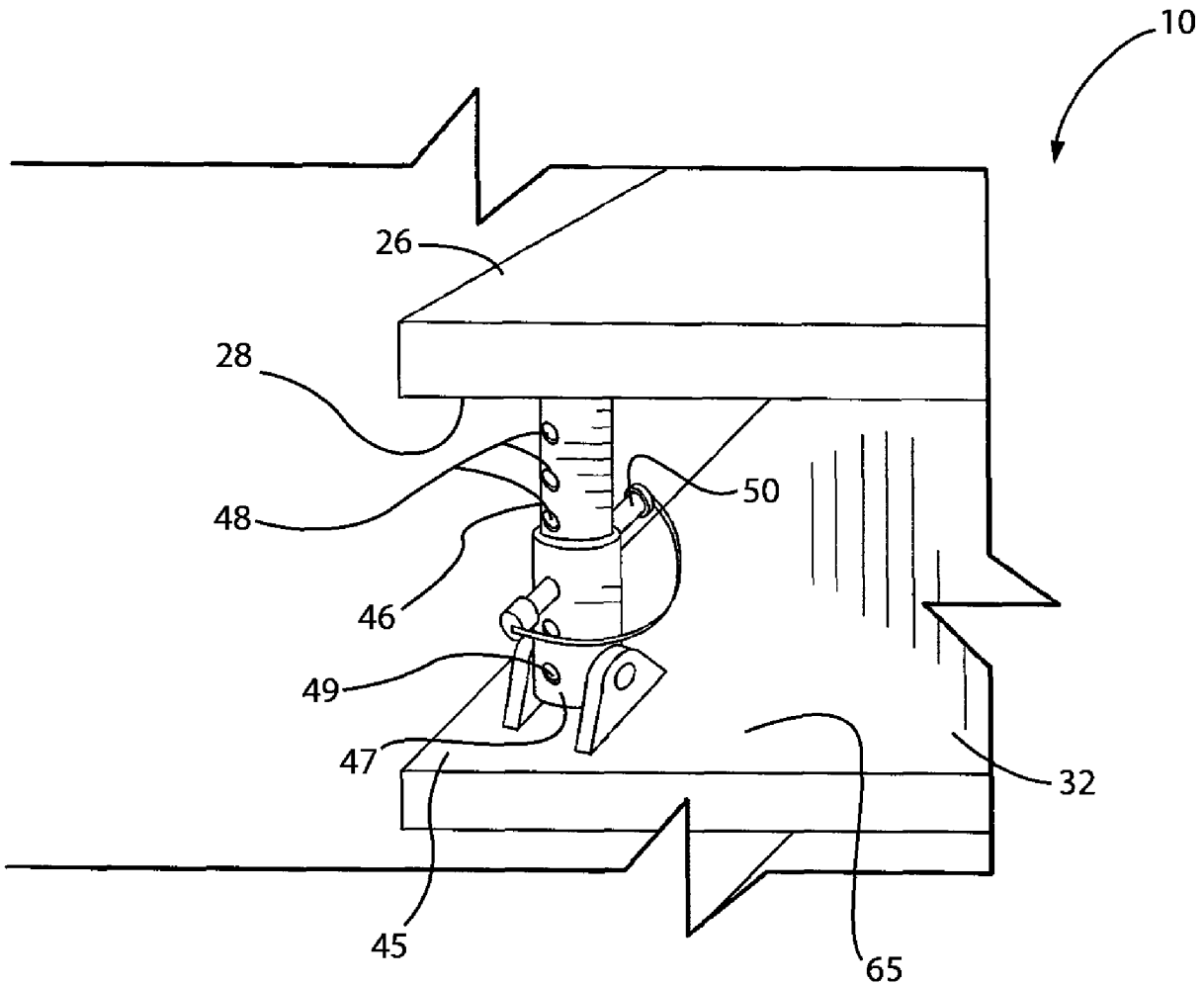
FIG. 4 is a perspective view of the shafts.
Figure 5:
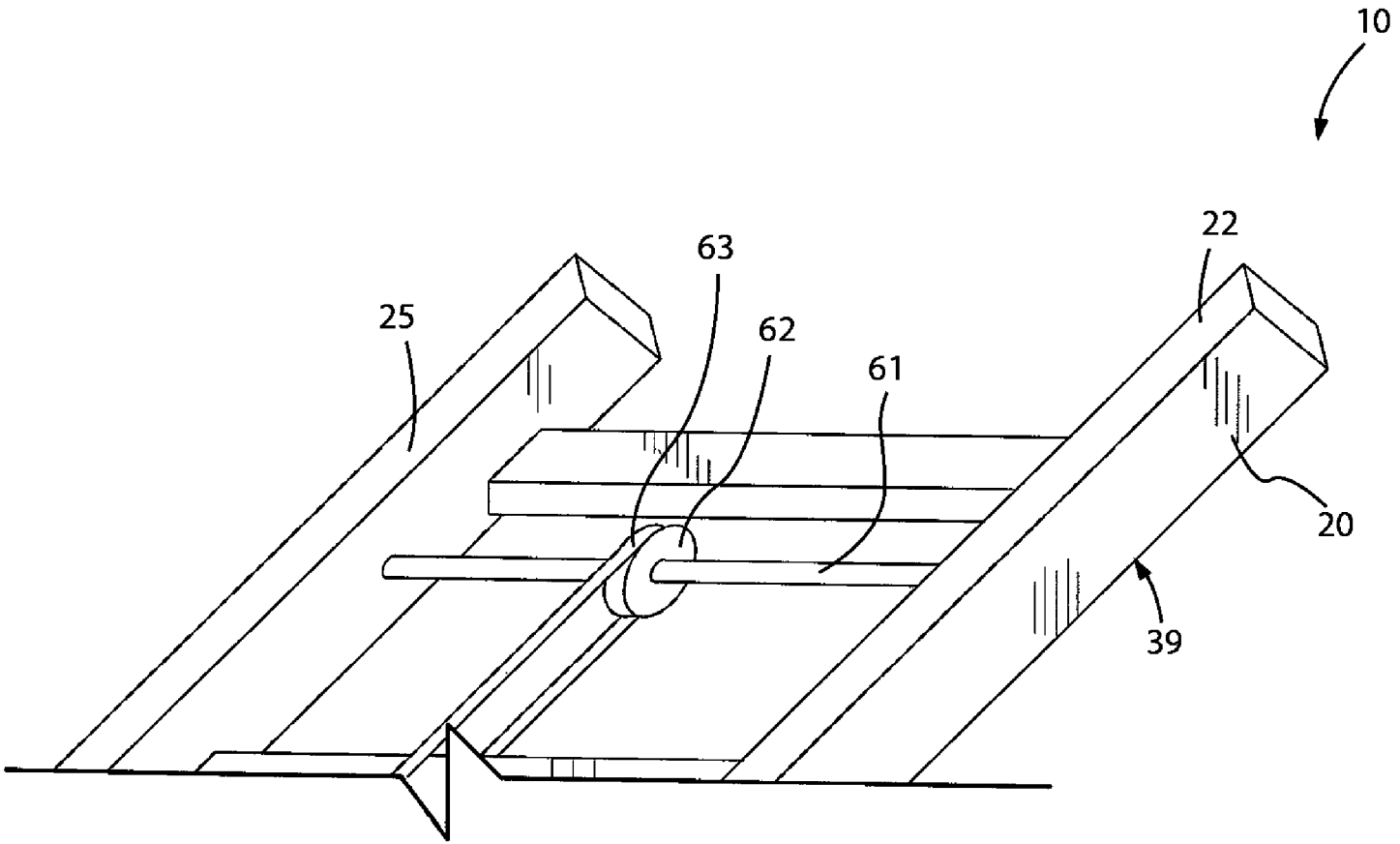
FIG. 5 is a perspective view of the rod and the grooved wheel respectively.

Referring to FIG. 4, the platform 30 further includes a plurality of telescopically adjustable shafts 46 that have opposed ends 47 pivotally attached to the bottom surface 28 of the support member 26 and the top surfaces 65 of the first and second panels 31, 32 respectively. Such shafts 46 are located at the opposed outside corners 45 of the bottom ends 35, 66 of the support member 26 and the first and second panels 31, 32 respectively. The shafts 46 are adjustable, which is vital such that the support member 26 can be maintained at a horizontal position regardless of the angle of incline of the ladder 20. In addition, the shafts 46 stabilize the support member 26 while the platform 30 is being raised and lowered.

Again referring to FIG. 4, the shafts 46 have a plurality of apertures 48 formed along a length thereof, which is necessary such that the apertures 48 form a continuous passageway 49 through a diameter of the shafts 46. A plurality of cotter pins 50 is removably interfitted within the apertures 48. Such cotter pins 50 are inserted into the apertures 48 for maintaining the shafts 46 at a substantially stable position and preventing the support member 26 from prematurely biasing toward the first and second panels 31, 32 during operating conditions. The placement of the apertures 48 allows a user to extend and secure the shafts 46 along the entire longitudinal length thereof.

Referring to FIGS. 1, 3, 6, 8 and 9, the assembly 10 further includes a mechanism 51 for raising and lowering the platform 30, which is essential such that the platform 30 is linearly adjustable along an entire longitudinal length of the ladder 20. Such a raising and lowering mechanism 51 allows a user to efficiently move an air-conditioning unit 12 from the lower end 24 of the ladder 20 to the upper end 22 of the ladder 20, or from the upper end 22 of the ladder 20 to the lower end 24 of the ladder 20 as desired. The raising and lowering mechanism 51 is anchored in close proximity to the lower end 24 of the ladder 20, which is critical such that the raising and lowering mechanism 51 is easily operable by the user while the user is standing on a ground surface 13 and in close proximity to the lower end 24 of the ladder 20. The platform raising and lowering mechanism 51 includes a housing 52 that has a user interface 53 formed within a top surface thereof, a motor 54 enclosed within the housing 52, and a receiver 75 connected to the motor 54.

Again referring to FIGS. 1, 3, 6, 8 and 9, the platform raising and lowering mechanism 51 further includes a driveshaft 55 that has a first end directly connected to the motor 54, without the use of intervening elements, and a second end extending outwardly from the housing 52 and disposed exterior thereof. Such a driveshaft 55 has a longitudinal axis oriented parallel with the bottom end 35 of the support member 26, and further has a spool 58 monolithically formed with the second end of the driveshaft 55. A remote device 59 operates the motor 54 from a distance when a user is not in close proximity to the lower end 24 of the ladder 20, and a power cord 60 is included.

Referring to FIGS. 1, 5, 6 and 8, the platform raising and lowering mechanism 51 further includes a rectilinear rod 61 spanning along an entire interior width of the ladder 20. Such a rod 61 is oriented perpendicular to a longitudinal length of the ladder 20 and further is anchored in close proximity to the upper end 22 of the ladder 20. Such placement of the rod 61 near the upper end 22 of the ladder 20 allows a user to raise the platform 30 as high as possible during operating conditions. A grooved wheel 62 is attached to a center portion of the rod 61 and is freely rotatable thereabout.

Again referring to FIGS. 1, 5, 6 and 8, the platform raising and lowering mechanism 51 further includes a flexible cord 63 nested within the grooved wheel 62. Such a cord 63 has a first end adjustably attached directly to the spool 58, without the use of intervening elements, and further has a second end statically attached to the platform 30. The flexibility of the cord 63 allows the cord 63 to be rotationally stored on the spool 58, and looped about the grooved wheel 62, without premature breakage of the cord 63 during raising and lowering of the platform 30. The cord 63 travels along a first linear path defined along the anterior face 25 of the ladder 20 and further travels along a second linear path defined along a posterior face 39 of the ladder 20. Such first and second linear paths are registered parallel to each other, and further are registered in parallel with the longitudinal length of the ladder 20, which is critical for preventing the platform 30 from shifting laterally during operating procedures and impeding the linear movement of the platform 30 during operating conditions.

Referring to FIGS. 1, 3, 6 and 8, the wheels 23 of the assembly 10 have a diameter greater than a distance between the anterior and posterior faces 25, 39 of the ladder 20, which is necessary such that the lower end 24 of the ladder 20 remains elevated above the ground surface after the upper end 22 of the ladder 20 is adapted towards the ground surface 13. For instance, when a user desires to move the ladder 20 from one location to another, the user lowers the upper end 22 of the ladder 20 toward the ground surface and thereby raises the lower end 24 of the ladder 20 above the ground surface such that the lower end 24 of the ladder 20 is spaced from the ground surface by the wheels 23. The user then pushes or pulls the ladder 20 to the desired location.

The ability of a user to pivotally adjust the support member 26 of the platform 30 provides the unexpected benefit of allowing a user to maintain an air-conditioning unit 12 placed thereon in a substantially horizontal plane during operating conditions regardless of the angle of incline of the ladder 20. In addition, the raising and lowering mechanism 51 allows a user to operate the assembly 10 while standing in close proximity to the ladder 20, or alternatively, from a distance via the remote device 59. Also, the wheels 23 allow a user to easily move the ladder 20 from one location to another without the assistance of another, thereby overcoming the shortcomings of the prior art.

In use, a method for raising and lowering an air-conditioning unit 12 above a ground surface includes the steps of providing a ladder 20, removably and pivotally attaching a plurality of fastening members 21 to an upper end 22 of the ladder 20, attaching a plurality of wheels 23 to a lower end 24 of the ladder 20, supporting the air-conditioning unit 12 on a platform 30 located at an anterior face 25 of the ladder 20, and raising and lowering the platform 30 such that the platform 30 is linearly adjustable along an entire longitudinal length of the ladder 20. The raising and lowering mechanism 51 is anchored in close proximity to the lower end 24 of the ladder 20 such that the raising and lowering mechanism 51 is easily operable by the user.

The method further includes the steps of providing a housing 52 that has a user interface 53 formed within a top surface thereof, providing a motor 54 enclosed within the housing 52, providing a receiver 75 connected to the motor 54, providing a driveshaft 55 that has a first end directly connected to the motor 54, without the use of intervening elements, and a second end extending outwardly from the housing 52 and disposed exterior thereof, providing a remote device 59 for operating the motor 54 from a distance, and providing a power cord 60. The driveshaft 55 has a longitudinal axis oriented parallel with the bottom end 35 of the support member 26, and further has a spool 58 monolithically formed with the second end of the driveshaft 55.

The method further includes the steps of spanning a rectilinear rod 61 along an entire interior width of the ladder 20, attaching a grooved wheel 62 to a center portion of the rod 61, and nesting a flexible cord 63 within the grooved wheel 62. The rod 61 is oriented perpendicular to a longitudinal length of the ladder 20 and further is anchored in close proximity to the upper end 22 of the ladder 20. The cord 63 has a first end adjustably attached directly to the spool 58, without the use of intervening elements, and a second end statically attached to the platform 30, and converts a rotating force generated by the motor 54 and transferred to the spool 58 into a lifting force applied to the platform 30. The cord 63 travels along a first linear path defined along the anterior face 25 of the ladder 20 and further travels along a second linear path defined along a posterior face 39 of the ladder 20. The first and second linear paths are registered parallel to each other.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A motor driven lifting assembly for assisting a user to raise and lower an air-conditioning unit above a ground surface, said lifting assembly comprising:

a ladder;

a plurality of fastening members removably and pivotally attached to an upper end of said ladder;

a plurality of wheels attached to a lower end of said ladder;

a platform for supporting the air-conditioning unit and located at an anterior face of said ladder; and means for raising and lowering said platform such that said platform is linearly adjustable along an entire longitudinal length of said ladder, wherein said platform comprises:

a planar support member having top and bottom surfaces, said support member being pivotally adjustable such that an object placed upon said top surface is maintained along a substantially horizontal plane above a ground surface while traveling along the longitudinal length of said ladder, said support member further having top and bottom ends oriented perpendicular to the longitudinal length of said ladder wherein said support member pivots about said top end;

first, second, third, and fourth planar panels, said first and second panels having top ends attached to said top end of said support member, said first and second panels further having bottom surfaces spaced from said anterior face of said ladder when said platform is attached to said ladder, said third and fourth panels having top surfaces spaced from a posterior face of said ladder when said platform is attached to said ladder and spaced from said bottom surfaces of said first and second panels, said first, second, third, and fourth panels being substantially similar in shape and size and having outside edges extending beyond a lateral width of said ladder;

a plurality of rectilinear spacers having axially opposed top and bottom ends, said top ends of said spacers being statically attached to said outside edges of said first and second panels respectively, said bottom ends of said spacers being statically attached to said outside edges of said third and fourth panels respectively, said spacers maintaining said first, second, third, and fourth panels rigidly affixed and equidistantly offset from said ladder during operating conditions;

a plurality of rollers directly attached to said spacers respectively, said rollers being further attached to said bottom surface of said first and second panels and said top surface of said third and fourth panels respectively, said rollers being located at opposed outside corners of said first, second, third, and fourth panels, said rollers directly contacting said anterior and posterior faces of said ladder respectively when said platform is attached thereto;

a plurality of telescopically adjustable shafts having opposed ends pivotally attached to said bottom surface of said support member and said top surfaces of said first and second panels respectively, said shafts being located at said opposed outside corners of said bottom ends of said support member and said first and second panels respectively, said shafts having a plurality of apertures formed along a length thereof such that said apertures form a continuous passageway through a diameter of said shafts; and a plurality of cotter pins removably interfitted within said apertures;

a plurality of linear tracks directly attached to the bottom surface of the first and second panels, respectively, and the top surface of the third and fourth panels, respectively, said tracks are oriented parallel to the longitudinal length of the ladder and adjacent to the outside edges of the first, second, third, and fourth panels, respectively, the rollers interfit within the tracks and freely rotate therein while the platform is being raised and lowered.

2. The lifting assembly of claim 1, wherein said platform raising and lowering means comprises:

a housing having a user interface formed within a top surface thereof;

a motor enclosed within said housing;

a driveshaft having a first end directly connected to said motor and a second end extending outwardly from said housing and disposed exterior thereof, said driveshaft having a longitudinal axis oriented parallel with said bottom end of said support member, said driveshaft further having a spool monolithically formed with said second end of said driveshaft;

a remote device for operating said motor from a distance; and a power cord.

3. The lifting assembly of claim 1, wherein said platform raising and lowering means further comprises:

a rectilinear rod spanning along an entire interior width of said ladder, said rod being oriented perpendicular to a longitudinal length of said ladder and further being anchored in close proximity to said upper end of said ladder;

a grooved wheel attached to a center portion of said rod and freely rotatable thereabout;

a flexible cord nested within said grooved wheel, said cord having a first end adjustably attached directly to said spool and further having a second end statically attached to said platform, said cord traveling along a first linear path defined along said anterior face of said ladder and further traveling along a second linear path defined along a posterior face of said ladder, said first and second linear paths being registered parallel to each other.

4. The lifting assembly of claim 1, wherein said fastening members adjustably attach said upper end of said ladder to a support surface during operating conditions such that a more stable environment is created while raising and lowering said platform.

5. The lifting assembly of claim 1, wherein said wheels have a diameter greater than a distance between said anterior and posterior faces of said ladder such that said lower end of said ladder remains elevated above the ground surface after said upper end of said ladder is adapted towards the ground surface.

6. A motor driven lifting assembly for assisting a user to raise and lower an air-conditioning unit above a ground surface, said lifting assembly comprising:

a ladder;

a plurality of fastening members removably and pivotally attached to an upper end of said ladder;

a plurality of wheels attached to a lower end of said ladder;

a platform for supporting the air-conditioning unit and located at an anterior face of said ladder; and means for raising and lowering said platform such that said platform is linearly adjustable along an entire longitudinal length of said ladder, wherein said raising and lowering means is anchored in close proximity to said lower end of said ladder such that said raising and lowering means is easily operable by the user, wherein said platform comprises:

a planar support member having top and bottom surfaces, said support member being pivotally adjustable such that an object placed upon said top surface is maintained along a substantially horizontal plane above a ground surface while traveling along the longitudinal length of said ladder, said support member further having top and bottom ends oriented perpendicular to the longitudinal length of said ladder wherein said support member pivots about said top end;

first, second, third, and fourth planar panels, said first and second panels having top ends attached to said top end of said support member, said first and second panels further having bottom surfaces spaced from said anterior face of said ladder when said platform is attached to said ladder, said third and fourth panels having top surfaces spaced from a posterior face of said ladder when said platform is attached to said ladder and spaced from said bottom surfaces of said first and second panels, said first, second, third, and fourth panels being substantially similar in shape and size and having outside edges extending beyond a lateral width of said ladder;

a plurality of rectilinear spacers having axially opposed top and bottom ends, said top ends of said spacers being statically attached to said outside edges of said first and second panels respectively, said bottom ends of said spacers being statically attached to said outside edges of said third and fourth panels respectively, said spacers maintaining said first, second, third, and fourth panels rigidly affixed and equidistantly offset from said ladder during operating conditions;

a plurality of rollers directly attached to said spacers respectively, said rollers being further attached to said bottom surface of said first and second panels and said top surface of said third and fourth panels respectively, said rollers being located at opposed outside corners of said first, second, third, and fourth panels, said rollers directly contacting said anterior and posterior faces of said ladder respectively when said platform is attached thereto;

a plurality of telescopically adjustable shafts having opposed ends pivotally attached to said bottom surface of said support member and said top surfaces of said first and second panels respectively, said shafts being located at said opposed outside corners of said bottom ends of said support member and said first and second panels respectively, said shafts having a plurality of apertures formed along a length thereof such that said apertures form a continuous passageway through a diameter of said shafts; and a plurality of cotter pins removably interfitted within said apertures;

a plurality of linear tracks directly attached to the bottom surface of the first and second panels, respectively, and the top surface of the third and fourth panels, respectively, said tracks are oriented parallel to the longitudinal length of the ladder and adjacent to the outside edges of the first, second, third, and fourth panels, respectively, the rollers interfit within the tracks and freely rotate therein while the platform is being raised and lowered.

7. The lifting assembly of claim 6, wherein said platform raising and lowering means comprises:

a housing having a user interface formed within a top surface thereof;

a motor enclosed within said housing;

a driveshaft having a first end directly connected to said motor and a second end extending outwardly from said housing and disposed exterior thereof, said driveshaft having a longitudinal axis oriented parallel with said bottom end of said support member, said driveshaft further having a spool monolithically formed with said second end of said driveshaft;

a remote device for operating said motor from a distance; and a power cord.

8. The lifting assembly of claim 7, wherein said platform raising and lowering means further comprises:

a rectilinear rod spanning along an entire interior width of said ladder, said rod being oriented perpendicular to a longitudinal length of said ladder and further being anchored in close proximity to said upper end of said ladder;

a grooved wheel attached to a center portion of said rod and freely rotatable thereabout;

a flexible cord nested within said grooved wheel, said cord having a first end adjustably attached directly to said spool and further having a second end statically attached to said platform, said cord traveling along a first linear path defined along said anterior face of said ladder and further traveling along a second linear path defined along a posterior face of said ladder, said first and second linear paths being registered parallel to each other.

9. The lifting assembly of claim 8, wherein said fastening members adjustably attach said upper end of said ladder to a support surface during operating conditions such that a more stable environment is created while raising and lowering said platform.

10. The lifting assembly of claim 9, wherein said wheels have a diameter greater than a distance between said anterior and posterior faces of said ladder such that said lower end of said ladder remains elevated above the ground surface after said upper end of said ladder is adapted towards the ground surface.

* * * * *